US005440333A

United States Patent [19]

Sykora et al.

[11] Patent Number: 5,440,333

[45] Date of Patent: * Aug. 8, 1995

[54] COLLAPSIBLE INK RESERVOIR AND INK-JET CARTRIDGE WITH PROTECTIVE BONDING LAYER FOR THE PRESSURE REGULATOR

[75] Inventors: James H. Sykora; Tofigh Khodapanah; David S. Hunt; George Kaplinsky; Joseph Scheffeling, all of San Diego; Amy V. Liew, Oceanside; Mark Van Veen, Ramona, all of Calif.; Joseph R. Elliot, Corvallis, Oreg.

[73] Assignee: Hewlett-Packard Company, Palo Alto, Calif.

[ * ] Notice: The portion of the term of this patent subsequent to Jan. 18, 2011 has been disclaimed.

[21] Appl. No.: 997,257

[22] Filed: Dec. 23, 1992

[51] Int. Cl.[6] ..... B41J 2/175

[52] U.S. Cl. ..... 347/87

[58] Field of Search ..... 346/140 R; 222/95; 347/87

[56] References Cited

U.S. PATENT DOCUMENTS 3,708,798 1/1973 Hildenbrand et al. ..... 347/33

5,280,300 1/1994 Fong et al. ..... 346/1.1

*Primary Examiner*—Benjamin R. Fuller

*Assistant Examiner*—Valerie Ann Lund

[57] ABSTRACT

An ink cartridge for a thermal ink jet printer containing a separate collapsible ink reservoir which is kept under negative pressure by a pressure regulator to prevent ink leakage. The collapsible reservoir has a pair of flexible plastic membrane ink bag sidewalls each connected at their periphery to form an ink bag and an ink pressure regulator in the bag. The pressure regulator comprises a pair of spaced parallel side plates urged apart by a spring toward the adjacent bag sidewalls whereby the reservoir is collapsible against the spring pressure to an essentially flat shape to permit substantially complete dispensation of ink from the bag. Inadvertent puncture of the thin bag walls by the regulator is prevented by a protective edge guard in the form of a layer of tough plastic bonded to the outer surfaces of the sideplates, the protective layers each having a peripheral edge which extends beyond the edge of the side plate to prevent the edges of the sideplates from directly contacting the bag walls. The regulator is centrally positioned and held in place between the flexible membrane bag walls, preferably by heat bonding of the bag walls to the edge guards.

26 Claims, 2 Drawing Sheets

14
16
19
24
B
60
51
50
41
40
30
13
5
10
20
21
18
22
B
12

FIG. 2
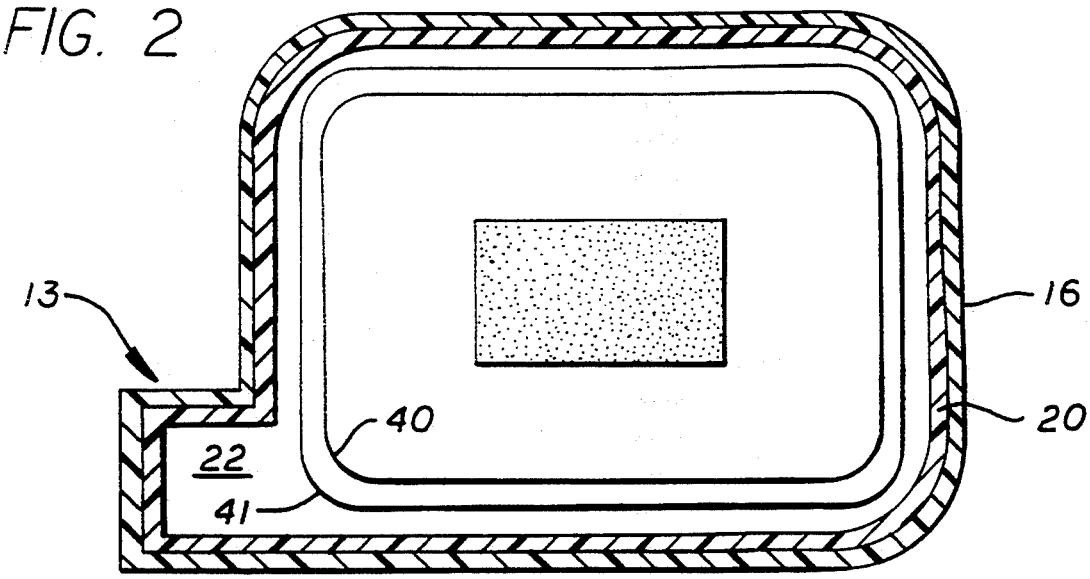
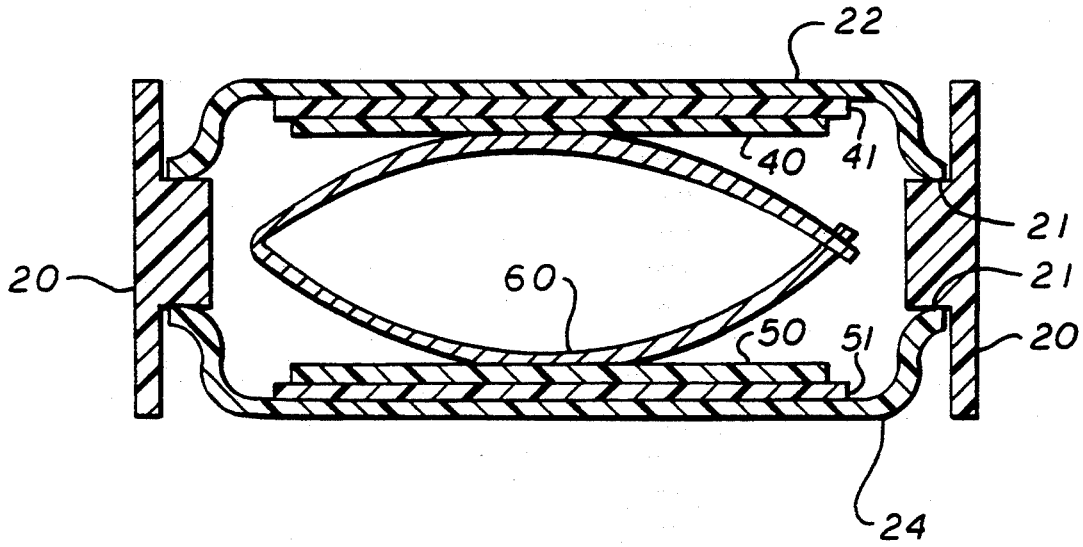
FIG. 3

COLLAPSIBLE INK RESERVOIR AND INK-JET CARTRIDGE WITH PROTECTIVE BONDING LAYER FOR THE PRESSURE REGULATOR

CROSS REFERENCE TO RELATED APPLICATIONS, IF ANY

The present invention is related to the following pending U.S. patent applications: COMPACT FLUID COUPLER FOR THERMAL INK JET PRINT CARTRIDGE IND RESERVOIR, Ser. No. 07/853,372 filed Mar. 18, 1992, by James G. Salter, et al; INK PRESSURE REGULATOR FOR A THERMAL INK-JET PRINTER, Ser. No. 07/928,811 filed Aug. 12, 1992, by Tofigh Khodapanah, et al; COLLAPSIBLE INK RESERVOIR STRUCTURE AND PRINTER INK CARTRIDGE, Ser. No. 07/929,615, filed Aug. 12, 1992, by George T. Kaplinsky, et al; TWO MATERIAL FRAME HAVING DISSIMILAR PROPERTIES FOR A THERMAL INK-JET CARTRIDGE, by David S. Swanson, et al, filed concurrently herewith, attorney docket number 109057-1; RIGID LOOP CASE STRUCTURE FOR THERMAL INK-JET PEN, by David W. Swanson, et al, filed concurrently herewith, attorney docket number 1093058-1; THERMAL INK-JET PEN WITH A PLASTIC/METAL ATTACHMENT FOR THE COVER, by Dale D. Timm, Jr., et al filed concurrently herewith, attorney docket number 1191150-1; THIN PEN STRUCTURE FOR THERMAL INK-JET PRINTER, by David W. Swanson, et al, filed concurrently herewith, attorney docket number 1092607-1; NEGATIVE PRESSURE INK DELIVERY SYSTEM, by George T. Kaplinsky, et al, filed concurrently herewith, attorney docket number 189045-1; LAMINATED FILM INK RESERVOIR, by Joseph Scheffelin, filed concurrently herewith, attorney docket number 1092419; SPRING BAG PRINTER INK CARTRIDGE WITH VOLUME INDICATOR, by David S. Hunt, et al, application Ser. No. 07/717,735 filed Jun. 19, 1991; the entire disclosures of which are incorporated herein by this reference.

BACKGROUND OF THE INVENTION AND PRIOR ART

The present invention relates generally to ink reservoirs for high speed computer driven inkjet printers and plotters and other applications where precise pattern dispensation of a fluid is required such as in the layout of circuit masks. In such printers the ink reservoir is ordinarily maintained under a sub-atmospheric or negative pressure so that ink will not leak or drool from the print head. Various types of ink reservoirs may be used including refillable ink reservoir cartridges which are mounted on the moveable printer carriage, throwaway replaceable cartridges which are mounted on the printer carriage and remote or offboard ink reservoirs from which ink is brought to the print head on the printer carriage by tubing. In the onboard refillable or throwaway cartridges, a polymer foam is ordinarily provided in the ink reservoir so that the capillary action of the foam will prevent ink from drooling from the print head. Polymeric foams of the type typically used for this purpose are non-biodegradable and thus cause environmental problems whenever a previously used cartridge is emptied and thrown away. In addition, the use of industrial foam in the ink reservoir restricts the operating pressure range of the ink cartridge and such foams ordinarily leave a chemical residue which is incompatible with and/or reacts adversely with printer ink. Similarly, the relatively long tubing used to convey ink from an offboard pressure reservoir to a printing head is not easily adaptable to deliver ink to the print head at different printing pressure ranges.

A collapsible ink reservoir for a handheld inkjet printer is disclosed in U.S. Pat. No. 4,422,084 issued Dec. 20, 1983 to Saito. Negative pressure is maintained in a polypropylene ink bag by various types of springs which bias the bag walls apart from each other. The springs may be mounted inside of or externally of the ink bag but the spring pressure regulator construction does not result in substantially complete emptying of the ink bag and the bag itself is not carried on a printer carriage.

Another ink reservoir which achieves constant negative back pressure through an external spring or an elastomeric bladder is disclosed in U.S. Pat. No. 4,509,062 issued Apr. 2, 1985.

One example of an improved onboard ink pressure reservoir cartridge is disclosed in U.S. patent application Ser. No. 07/717,735 filed Jun. 19, 1991 entitled SPRING-BAG PRINTER INK CARTRIDGE WITH VOLUME INDICATOR filed by David S. Hunt and W. Bruce Reid and assigned to the assignee of the present invention. The cartridge disclosed in that application basically comprises a rectangular housing containing a flexible bag of ink, an ink filter and a print head which receives ink from the filter. A spring inside of the bag of ink urges its flexible walls apart from each other thus maintaining a negative or sub-atmospheric pressure in the reservoir which is overcome as ink is emitted from the printhead. As seen in that application, the spring essentially consists of a pair of spaced parallel plates which are urged apart by a spring.

Also of interest are prior co-pending U.S. patent applications Ser. No. 07/929,615 filed Aug. 12, 1992 by Kaplinsky, et al titled COLLAPSIBLE INK RESERVOIR STRUCTURE AND PRINTER INK CARTRIDGE and Ser. No. 07/928,811 filed Aug. 12, 1992 by Khodapanah, et al, titled INK PRESSURE REGULATOR FOR A THERMAL INK JET PRINTER, both owned by the assignee of the present application and incorporated by reference herein.

Further developments of this collapsible bag technology are disclosed in the United States patent application filed on the same day as this application titled LAMINATED FILM INK RESERVOIR by Joseph Scheffelin, owned by the assignee of the present application and incorporated by reference herein.

In collapsible ink bag reservoirs of the type which employ regulator springs inside of thin wall flexible bag walls, it has been found that despite careful handling and packaging, the relatively rigid pressure regulator sideplates may, during shipment or installation puncture the flexible membranes. Although such puncturing is quite rare, this cutting or puncturing must be totally avoided yet this objective must be accomplished without unduly thickening the bag walls so that ink can still be substantially completely exhausted from the collapsible reservoir. In some instances, the regulator springs and their side plates may shift into a skewed position due to shock or vibration. This further increases the risk of unused ink remaining in the reservoir or of damaging contact with the flexible membranes.

SUMMARY OF THE INVENTION

The present invention provides a collapsible ink reservoir to be maintained under negative pressure in a liquid ink cartridge, said ink reservoir comprising:

a) a pair of ink bag sidewalls each connected at their periphery to form an ink bag, at least one of said walls being flexible;

b) a pressure regulator in said bag comprising at least one side plate and a spring urging said side plate toward said flexible bag sidewall; and c) bonding means affixing said side plate to said flexible bag sidewall to maintain the position of said regulator in said bag.

The present invention further provides a thermal ink jet printer cartridge comprising: a rigid housing containing an ink reservoir to be maintained under negative pressure, said reservoir comprising:

a) a pair of ink bag sidewalls each connected to said rigid housing to form an ink bag, at least one of said walls being flexible;

b) a pressure regulator in said bag comprising at least one side plate and a spring urging said side plate toward said flexible bag sidewall; and c) a protective edge guard affixed to said side plate to prevent direct contact of the edges of said side plate with said flexible bag sidewall.

In its method aspects, the invention provides a method of providing a securely positioned spring member inside an ink-jet print cartridge reservoir having flexible film walls, comprising the steps of:

positioning a plate between the spring member and the film walls;

defining a predetermined bonding area in a central portion of the plate; and bonding an outer surface of the plate to an inner surface of the film walls in the predetermined bonding area.

BRIEF DESCRIPTION OF THE DRAWINGS

FIG. 2 is a sectional elevation view of the cartridge of FIG. 1 taken at line 2—2 on FIG. 3.

FIG. 3 is a sectional plan view of the cartridge seen in FIG. 2 with partial enlargements at the sections shown thereon.

DESCRIPTION OF THE PREFERRED EMBODIMENT

Figure 1:
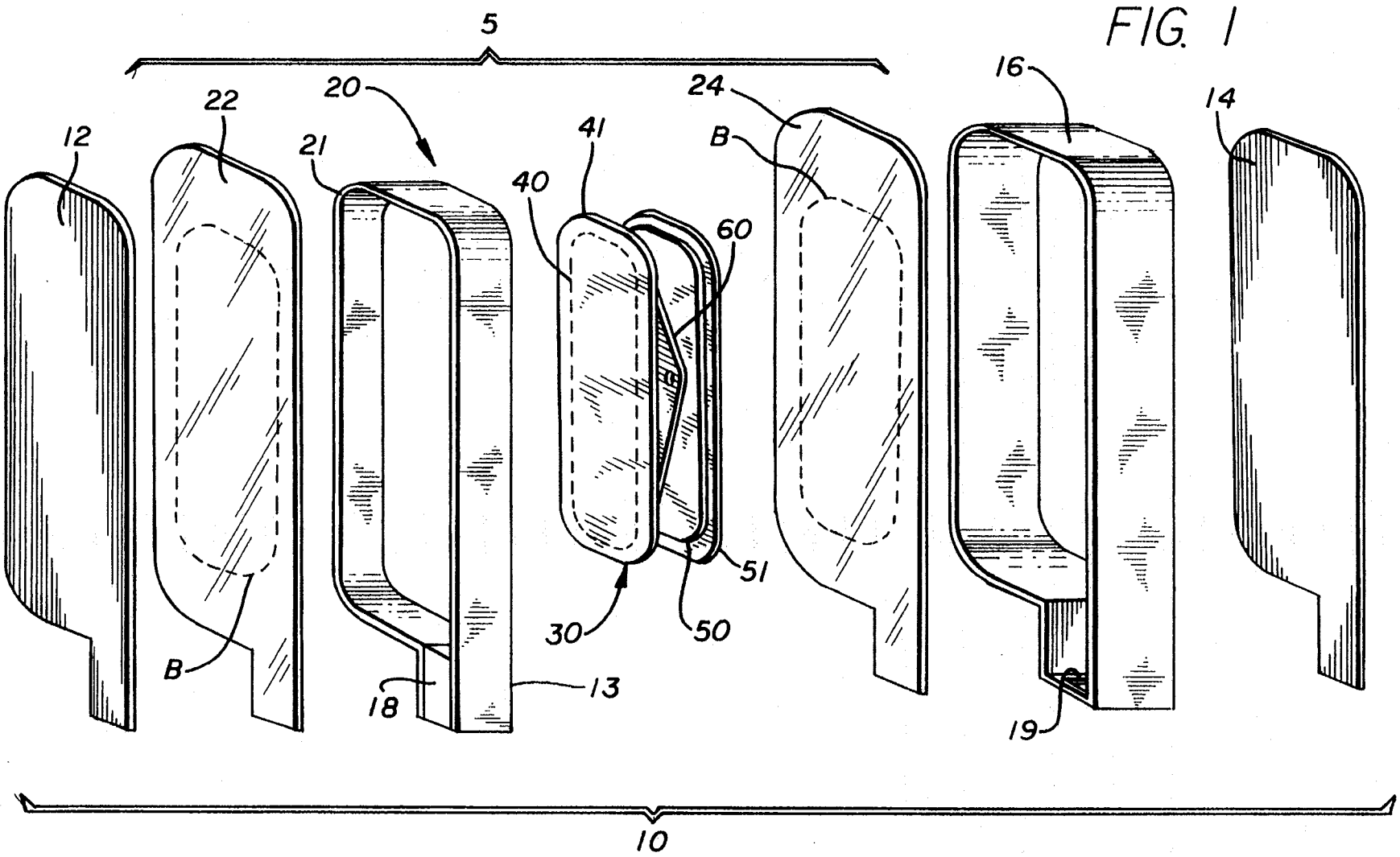
FIG. 1 is an exploded perspective view of a replaceable or throwaway ink cartridge for a thermal inkjet printer.

The drawing shows a replaceable ink cartridge comprising a rigid outer housing 10 having a pair of spaced cover plates 12, 14 intended to be affixed as by heat bonding, or adhesive, or preferably press fit through interlocking tabs to opposite sides of a plastic peripheral wall section 16. Snout portion 13 of the cartridge has an ink discharge aperture in its lowermost end wall (as seen in FIG. 1) to which is affixed an electrically driven print head, not shown.

An inner collapsible reservoir structure unit 5 comprised of a relatively rigid inner plastic frame 20 and a pair of ink bag sidewalls 22, 24, at least one of which is flexible membrane such as plastic, attached thereto is mounted in the outer housing 10. Preferably, inner frame 20 is molded with the outer housing 10 in a two step injection molding process. Inner frame 20 is formed of a softer and lower melting point plastic than the plastic of housing 10 to permit heat bonding of the bag walls 22, 24 thereto. Alternatively, inner frame 20 may be separately constructed with some flexibility to assist in mounting it in the housing 10 but the frame 20 is rigid relative to the flexible ink bag membranes described below.

The frame 20 has a pair of opposite side edges 21 to which the flexible plastic ink bag membranes 22, 24 are respectively joined as by heat welding at their peripheral edges to form the reservoir structure 25. The reservoir structure 25 contains a pressure regulator 30 which in turn is preferably comprised of a pair of spaced substantially parallel metal sideplates 40, 50 urged apart by a bow spring 60 toward the flexible membranes 22, 24. The assembled reservoir structure including the inner frame 20, membranes 22, 24 and pressure regulator 30 is then mounted inside of wall section 16 of the cartridge and side walls 12, 14 are then affixed to the cartridge housing peripheral wall 16. The snout portion 13 of housing 10 also contains an ink filter 18 which is placed in fluid communication with the flexible ink bag reservoir. The filter 18 may be mounted inside the reservoir structure or it can be positioned outside of the reservoir structure but inside outer housing 10 with minor porting and seal modifications to ensure fluid communication from the ink reservoir to the filter 18. The lowermost portion of the peripheral outer housing wall 16 (as viewed in FIG. 1) is provided with an ink discharge aperture 19 through which ink is downwardly discharged from the filter 18 to the print head, not shown.

The pressure regulator sideplates 40, 50 may be individually cut from a continuous metal strip of metal such as stainless steel, each plate being of generally rectangular configuration with rounded corners to minimize damaging the flexible bag membranes.

The bow spring 60 also may conveniently be cut from a common strip of metal such as stainless steel.

The bow spring 60 is affixed, preferably by spot or laser welding at the apexes of each of its bights centrally onto each of the sideplates 40, 50.

An edge guard in the form of a thin but tough polyethylene cover layer 41, 51 having an acrylic adhesive on one surface thereof may then be press bonded to the outer surface of each side plate 40, 50 if desired. The cover layers 41, 51 are each sized slightly larger than the side plates 40, 50 so that a marginal width of approximately 1.2 millimeters of the cover layers extends beyond each edge of the metal plates 40, 50 to prevent those edges from contacting the comparatively delicate plastic bag wall membranes 22, 24.

The pressure regulator 30 is centrally positioned in the frame 20 and housing 10 and the two flexible plastic ink bag sidewalls or membranes 22, 24 are then heat bonded or cemented at their peripheral edges to the edge wall 21 of the inner plastic frame 20, care being taken to maintain the central positioning at all times of the regulator and cover layers 41, 51 in the frame 20 between the flexible membrane walls 22, 24. The bag walls 22, 24 are then securely affixed to the pressure regulator 30 preferably by heat bonding the membrane bag walls 22, 24 to the cover layers 41, 51 in the area bounded by the broken line B. This heat bonding has the primary purpose of preventing relative motion between the pressure regulator 30 and preventing direct contact of the metal sideplates 40, 50 with the relatively delicate membrane bag walls 22, 24 to prevent the edges of the sideplates from cutting or puncturing the membranes. In the absence of any protective cover layers, the bag walls may be directly bonded by heat bonding or suitable adhesive to the pressure regulator. Either method of construction also reduces the area of ink contact with the membrane walls 22, 24 which in turn minimizes the migration of moisture from the ink through the membranes. Such migration, over time, degrades the ink quality and this problem is thus minimized. In one embodiment the dimensions of the dashed line area of heat bonding are approximately 8 mm by 29 mm. and the heat bond area is centrally located on the sideplates 40, 50. In another embodiment, the regulator side plates and bag sidewalls are initially assembled to be in moveable contact with each other. Thereafter, a heated platen momentarily contacts the film and fuses the film to the plate. A slight vacuum must be applied to the inside of the frame to improve the quality of the fusion.

As ink is withdrawn from the reservoir bag, the flexible sidewalls 22, 24 of the ink bag and the pressure regulator sideplates 40, 50 gradually move towards each other until the spring is in an essentially flat configuration with the two sideplates 40, 50 coming virtually into contact with each other so that the bag is substantially completely emptied of ink.

Persons skilled in the art will readily appreciate that various modifications can be made from the preferred embodiment thus the scope of protection is intended to be defined only by the limitations of the appended claims. For example, the cover layers 41, 51 may in some instances be unnecessary and an ink bag having a single flexible membrane wall instead of two flexible membrane walls might be constructed. In this instance, the pressure regulator need only have a single side plate urged into engagement by a spring with the single flexible membrane bag wall.

It is therefore understood from the foregoing description that the invention provides a bonding technique to assure that the regulator is centrally positioned and always held in its proper place between the flexible membrane bag walls, preferably by heat bonding of the bag walls to an edge guard layer covering the outer surface of the two side plates 40, 50.

In such a preferred embodiment of the invention, inadvertent puncture of the thin bag walls by the regulator is prevented by a protective edge guard in the form of a layer of tough plastic bonded to the outer surface of the side plates, the protective layers each having a peripheral edge which extends beyond the edge of the side plate to prevent the edges of the side plates from directly contacting the bag walls.

We claim:

1. A collapsible ink reservoir to be maintained under negative pressure in a liquid ink cartridge, said ink reservoir comprising:

a) a pair of ink bag sidewalls each having a periphery and each connected at said periphery to form an ink bag, at least one of said walls being flexible;

b) a pressure regulator in said bag comprising at least one side plate having edges and a spring urging said side plate toward said flexible bag sidewall; and c) bonding means affixing said side plate to said flexible bag sidewall to maintain the position of said regulator in said bag.

2. The ink reservoir of claim 1, wherein said bonding means further comprises a protective edge guard affixed to said side plate to prevent direct contact of said edges of said side plate with said flexible bag sidewall.

3. The ink reservoir of claim 2, wherein each of said sidewalls of said bag are flexible, said pressure regulator having a pair of spaced side plates which are urged apart by said spring, each said side plate having a protective edge guard affixed thereto.

4. The ink reservoir of claim 3, wherein said edge guards are bonded to surfaces of the respective sideplates which face said bag sidewalls.

5. The ink reservoir of claim 4, wherein said edge guards comprise a film of plastic material adhesively bonded to said sideplates.

6. The ink reservoir of claim 5, wherein said bag sidewalls are plastic.

7. The ink reservoir of claim 6, wherein said films of plastic material are heat bonded to said plastic bag sidewalls.

8. The ink reservoir of claim 7, further comprising a peripheral frame which is relatively rigid compared to said flexible ink bag sidewalls, said sidewalls each having a periphery and each sidewall being joined at said periphery to said frame.

9. The ink reservoir of claim 1, wherein each of said side plates has a side area and a central bonding area which is less than half said side area of the plate.

10. The ink reservoir of claim 1, wherein said plates are heat-bonded to said bag sidewalls.

11. The ink reservoir of claim 9, wherein said plates are substantially parallel to each other.

12. The ink reservoir of claim 1, wherein said bag sidewall is directly affixed to said side plate.

13. A thermal ink jet printer cartridge comprising: a rigid housing containing an ink reservoir to be maintained under negative pressure, said reservoir comprising:

a) a pair of ink bag sidewalls each connected to said rigid housing to form an ink bag, at least one of said walls being flexible;

b) a pressure regulator in said bag comprising at least one side plate bounding an outer surface and a spring urging said side plate toward said flexible bag sidewall; and c) a protective edge guard affixed to said side plate to prevent direct contact of said edges of said side plate with said flexible bag sidewall.

14. The ink cartridge of claim 13, wherein said cartridge further includes means affixing said side plate to said flexible bag sidewall to maintain the position of said regulator in said bag.

15. The ink cartridge of claim 14, wherein each of said sidewalls of said bag is flexible, said pressure regulator having a pair of spaced side plates which are urged apart by said spring, each said side plate having a protective edge guard affixed thereto.

16. The ink cartridge of claim 15, wherein said edge guards are bonded to surfaces of the respective sideplates which face said flexible bag sidewalls.

17. The ink cartridge of claim 16, wherein said edge guards comprise a film of plastic material adhesively bonded to substantially all of said [outer]surfaces of said sideplates which face said flexible bag sidewalls.

18. The ink cartridge of claim 17, wherein said bag sidewalls are plastic.

19. The ink cartridge of claim 18, wherein said films of plastic material are heat bonded to said plastic bag sidewalls.

20. The ink cartridge of claim 19, further comprising a peripheral frame which is relatively rigid compared to said flexible ink bag sidewalls, said sidewalls each being joined at their periphery to said frame.

21. The ink cartridge of claim 20, wherein each of said plates is of generally rectangular configuration and has rounded corners.

22. The ink cartridge of claim 20, wherein said plates are stainless steel.

23. The ink cartridge of claim 20, wherein said plates are substantially parallel to each other.

24. A method of providing a securely positioned spring member inside an ink-jet print cartridge reservoir having flexible film walls, comprising the steps of:

positioning a plate having a periphery between the spring member and the film walls;

defining a bonding area in a central portion of the plate; and bonding an outer surface of the plate to an inner surface of the film walls in the bonding area.

25. The method of claim 24, wherein said bonding step includes using an intermediate layer of material between the plate and the film walls to facilitate bonding.

26. The method of claim 25, which further includes extending the intermediate layer of material beyond the periphery of the plate to prevent the plate from puncturing the film walls.

* * * * *